US006279450B1

(12) United States Patent
Schmees

(10) Patent No.: US 6,279,450 B1
(45) Date of Patent: Aug. 28, 2001

(54) LOADING APPARATUS FOR A LARGE-CALIBER WEAPON

(75) Inventor: Heiner Schmees, Celle (DE)

(73) Assignee: Rheinmetall W&M GmbH, Unterlüss (DE)

( * ) Notice: Subject to any disclaimer, the term of this patent is extended or adjusted under 35 U.S.C. 154(b) by 0 days.

(21) Appl. No.: 09/533,985

(22) Filed: Mar. 24, 2000

(30) Foreign Application Priority Data

Mar. 24, 1999 (DE) ..... 199 13 283

(51) Int. Cl.[7] ..... F41A 9/42
(52) U.S. Cl. ..... 89/45; 89/33.01
(58) Field of Search ..... 89/45, 33.01

(56) References Cited

U.S. PATENT DOCUMENTS

| | | | | |
|---|---|---|---|---|
| 2,785,607 | * | 3/1957 | Henstrom et al. | 89/45 |
| 3,986,432 | * | 10/1976 | Schreckenberg | 89/45 |
| 4,457,209 | * | 7/1984 | Scheurich et al. | 89/45 |
| 5,347,911 | * | 9/1994 | Hallqvist | 89/45 |
| 5,844,163 | * | 12/1998 | Lindskog | 89/45 |

FOREIGN PATENT DOCUMENTS

| | | |
|---|---|---|
| 25 01 426 | 7/1975 | (DE) . |
| 32 38 893 | 4/1984 | (DE) . |
| 31 32 631 | 11/1988 | (DE) . |

* cited by examiner

*Primary Examiner*—Charles T. Jordan
(74) *Attorney, Agent, or Firm*—Venable; Gabor J. Kelemen

(57) ABSTRACT

A weapon includes a weapon barrel having a longitudinal axis and a magazine positioned behind the weapon barrel and formed of two spaced, facing partial magazines situated on either side of the barrel axis. Each partial magazine has at least one tier accommodating a series of ammunition in a side-by-side relationship. A loading tray is positioned behind the weapon barrel and between the partial magazines for receiving ammunition therefrom to be loaded by the loading tray into the weapon barrel. A displacing mechanism shifts the ammunition in each tier onto the loading tray. At least two spaced guide rails are positioned in each tier and extend perpendicularly to the barrel axis. Each ammunition has a frontal region, a rearward region and at least two guide portions releasably secured to the ammunition in the frontal and rearward regions, respectively. The guide portions engage into respective guide rails.

6 Claims, 3 Drawing Sheets

13
1
2
10
24
20
3
21
9
21
23
14
16
10
22
22
12
17
15
21
5,7
20
22
6,11
22
21
5,8
4

LOADING APPARATUS FOR A LARGE-CALIBER WEAPON

CROSS REFERENCE TO RELATED APPLICATION

This application claims the priority of German Application No. 199 13 283.6, filed Mar. 24, 1999, which is incorporated herein by reference.

BACKGROUND OF THE INVENTION

This invention relates to a loading apparatus for a large-caliber weapon, including an ammunition magazine situated behind the weapon and a device for loading the weapon.

Loading apparatus of the above-outlined type are disclosed, for example, in German Offenlegungsschriften (applications published without examination) 25 01 426 and 32 38 893 as well as German Patent No. 31 32 631. In the known loading apparatus described therein the ammunition magazines are designed as circulating magazines and require complex devices for supporting and guiding the ammunition. Such devices occupy a relatively large space and are of substantial weight. Further, circulating magazines may be charged, as a rule, only in two or four tiers so that the space available for the magazine is often not optimally utilized.

SUMMARY OF THE INVENTION

It is an object of the invention to provide a weapon having an improved loading apparatus of the above-outlined type which is of simple construction and which makes possible an optimal utilization of the available space.

This object and others to become apparent as the specification progresses, are accomplished by the invention, according to which, briefly stated, the weapon includes a weapon barrel having a longitudinal axis and a magazine positioned behind the weapon barrel and formed of two spaced, facing, partial magazines situated on either side of the barrel axis. Each partial magazine has at least one tier accommodating a series of ammunition in a side-by-side relationship. A loading tray is positioned behind the weapon barrel and between the partial magazines for receiving ammunition therefrom to be loaded by the loading tray into the weapon barrel. A displacing mechanism shifts the ammunition in each tier onto the loading tray. At least two spaced guide rails are positioned in each tier and extend perpendicularly to the barrel axis. Each ammunition has a frontal region, a rearward region and at least two guide portions releasably secured to the ammunition in the frontal and rearward regions, respectively. The guide portions engage into respective guide rails.

According to the basic principle of the invention the ammunition magazine of the loading apparatus is composed of two partial magazines which are in a mirror-image arrangement and which are located at the rear of the weapon. Between the partial magazines a loading tray is situated for charging the weapon. In the partial magazines the ammunition is arranged in several superposed tiers. The ammunition in each tier is disposed horizontally side-by-side and is shiftable transversely to the longitudinal axis of the weapon barrel. Each tier is bounded by guide rails forming part of the magazine. Each piece of ammunition carries guide portions which project into the respective guide rails. The loading tray is vertically movable and thus forms part of an elevator for receiving ammunition from any tier and moving the ammunition into a loading position.

With each tier drives are associated which shift the ammunition towards the elevator transversely to the longitudinal axis of the weapon barrel. Thereafter the elevator moves into the loading position and a charger subsequently axially moves the ammunition through an opening out of the magazine and into the chamber of the weapon barrel. During this occurrence, the ammunition is stripped of the guide portions.

By virtue of the simple mechanical construction of the magazine according to the invention, a high degree of operational reliability and a low weight compared to similar known loading apparatus are ensured. Further, by varying the number of tiers and the number of ammunition for each tier the loading capacity and the magazine outline may be adapted optimally to the available space and/or environment (for example, a tank turret)

To ensure that the ammunition is held captive in the guide rails, the latter have retractable abutments at their ends oriented towards the loading tray. The respective abutment is pivoted away (retracted) only after the elevator has been moved to the predetermined tier for receiving an ammunition, and then the ammunition is shifted one step to bring a new piece of ammunition in alignment with the loading tray to be pushed thereonto by the charger.

The guide portions of the ammunition may be of very simple construction. They have to withstand, however, mechanical stresses in the magazine. Further, the guide portions must be separable from the ammunition during he loading process and must be removable.

Guide portions of the above-outlined type require very little space compared to known loading sleeves which are generally used in circulating magazines. The guide portions may be made, for example, of hard foam material, rubber, plastics, natural fibers, wood, craft paper or compound materials. The selection of the material depends, among others, from the expected stresses and whether the guide portions should be of the reusable type. The manner in which the guide portions are to be separated from the ammunition upon introducing the ammunition into the weapon barrel is affected by the material selected for the guide portions. Thus, in case of relatively soft materials, the separation of the guide portions may occur by cutting or breaking deliberately weakened areas. If relatively hard materials are used for the guide portions, they may be held together by a strap which is severed during the loading process.

The guide portions are preferably so constructed that they also constitute parts of the packaging which is required for the transport and storing of the ammunition externally of the magazine.

DESCRIPTION OF THE PREFERRED EMBODIMENTS

Figure 1:
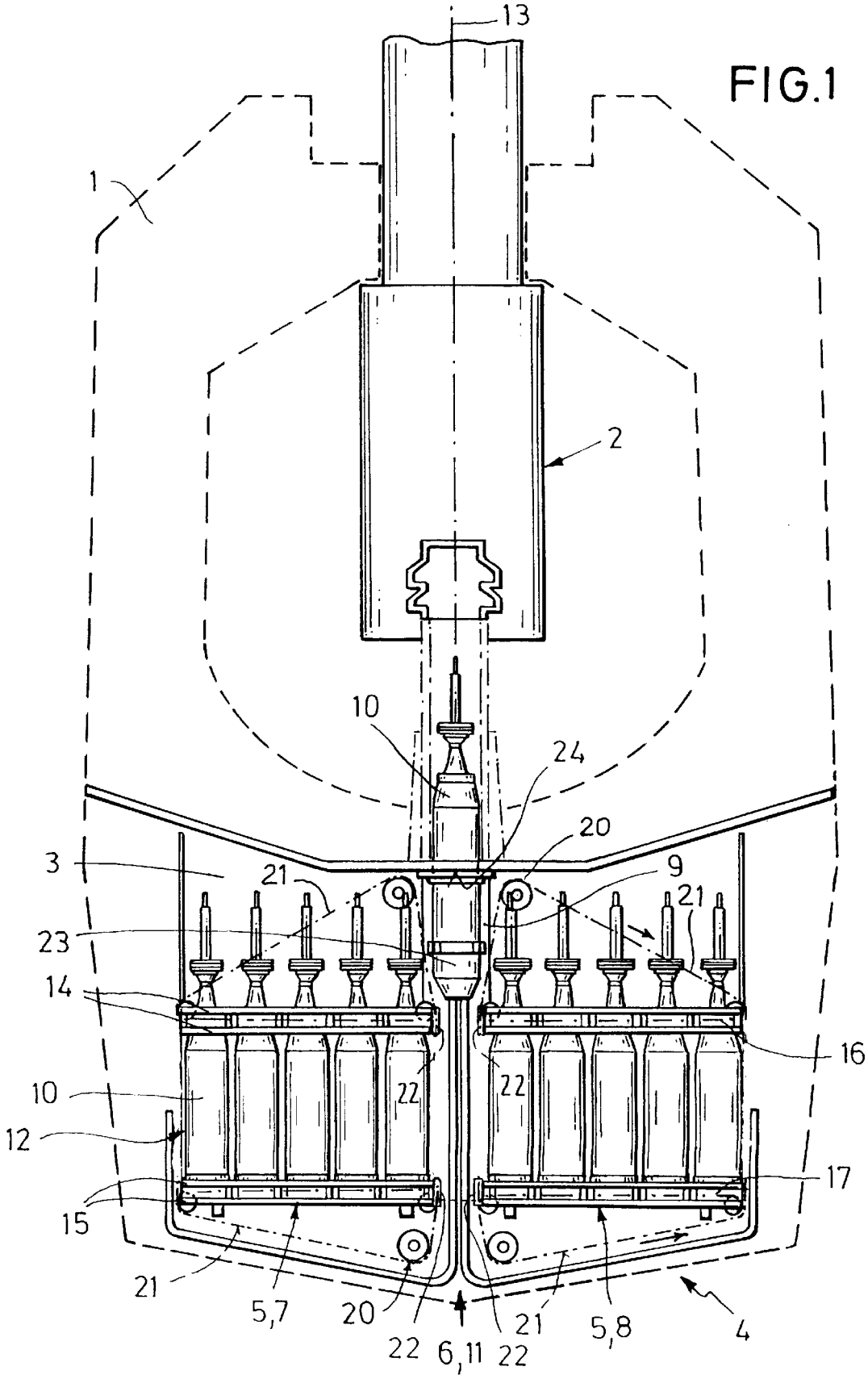
FIG. 1 is a top plan view of a tank turret, a rearward terminal portion of a weapon and a loading apparatus according to a preferred embodiment of the invention, including an ammunition magazine for one-part ammunition.

FIG. 1 illustrates a tank turret 1 supporting a weapon 2. Rearwardly of the weapon 2 in the tank turret 1 a magazine chamber 3 is provided in which the loading apparatus 4 according to the invention is accommodated. The loading apparatus 4 includes an ammunition magazine 5 and a device 6 for loading the weapon 2.

The ammunition magazine 5 is composed of two partial magazines 7 and 8 which are of a mirror-image construction and which face one another. Between the partial magazines 7 and 8 a loading tray 9 is disposed for receiving an ammunition 10 from the magazine 5 for charging the weapon 2. The loading tray 9 forms part of an elevator 11. The partial magazines 7, 8 each have, for example, three tiers 12, of which only the top tier of the respective partial magazine 7 and 8 is shown. In each tier 12 a series of ammunition 10 is arranged side-by-side in a single plane. The series of ammunition is shiftable transversely to the longitudinal axis 13 of the weapon barrel 2.

Figure 2:
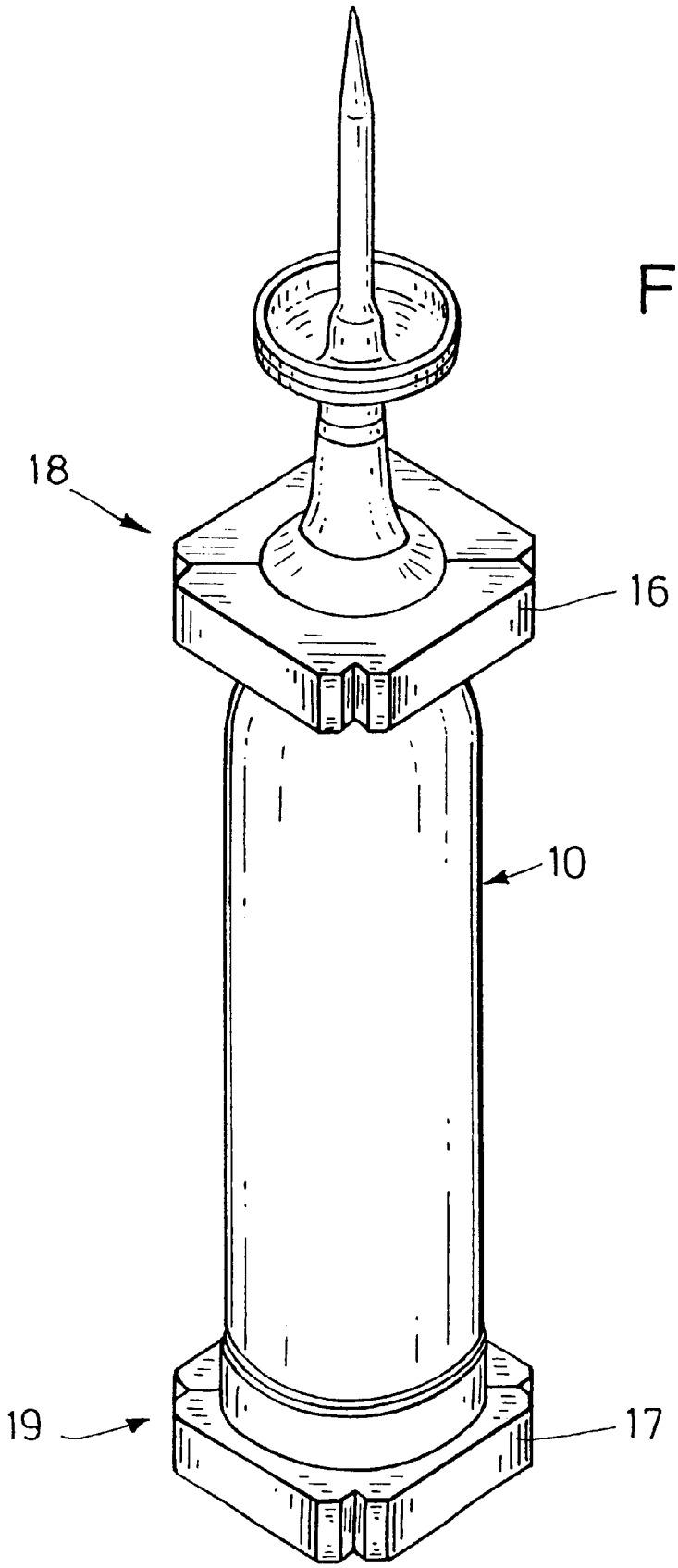
FIG. 2 is a perspective view of an ammunition, including forward and rearward guide portions.

In each tier 12 of the partial magazines 7, 8 two guide rails 14, 15 are arranged which extend transversely to the longitudinal axis 13 of the weapon barrel. Respective guide portions 16, 17 (FIG. 2) of the ammunition project into the guide rails 14, 15. The guide portions 16, 17 surround and are removably secured to, each ammunition 10 in its frontal and rearward parts 18 and 19.

Further, with each tier 12 of the partial magazines 7, 8 a drive 20 is associated which shifts the ammunition by means of chains 21 along the guide rails 14, 15 toward the loading tray 9 of the elevator 11.

To ensure that the ammunition 10 is held captive by the guide rails 14, 15, the latter have retractable abutments 22 at their ends oriented towards the loading tray 9. The respective abutment 22 is pivoted away (retracted) only when the elevator 11 for receiving ammunition 10 from the predetermined tier 12 of the magazine 5 is moved thereto and then the ammunition 10 is, by the drive 20, advanced one step toward the loading tray 9 so that the leading ammunition 10 of the series leaves the rails 14, 15 and arrives into alignment with the loading tray 9 to be pushed thereinto. Subsequently, the elevator 11 is moved into the loading position from which a charger 23 of the loading device 6 moves the ammunition 10 axially through an opening 24 of the magazine space 3 in the direction of the weapon 2. During this occurrence the ammunition 10 is separated from the guide portions 16, 17 which may be collected or ejected from the tank turret.

The loading of the ammunition magazine 5 may be performed in various ways. According to a first embodiment of the invention, the loading occurs from the side of the ammunition magazine 5. For this purpose for each tier 12 a downwardly opening flap is provided in the turret which, at its inner surface, is contoured such that in the open state it serves as an extension of the guide rails. The ammunition may thus be advanced from a loading platform of, for example, a truck, over a ramp into the opened gate and therefrom into the magazine 5.

According to a second embodiment of the invention, the guide rails and the mechanisms for advancing the ammunition in the respective partial magazine 7, 8, constitute a unit which as a whole may be replaced by a crane through the opened magazine roof. This shortens and simplifies the magazine loading process. The empty partial magazines may subsequently be re-loaded in a depot. The control and the drive of the partial magazines are components of the tank turret and are thus not replaced.

Figure 3:
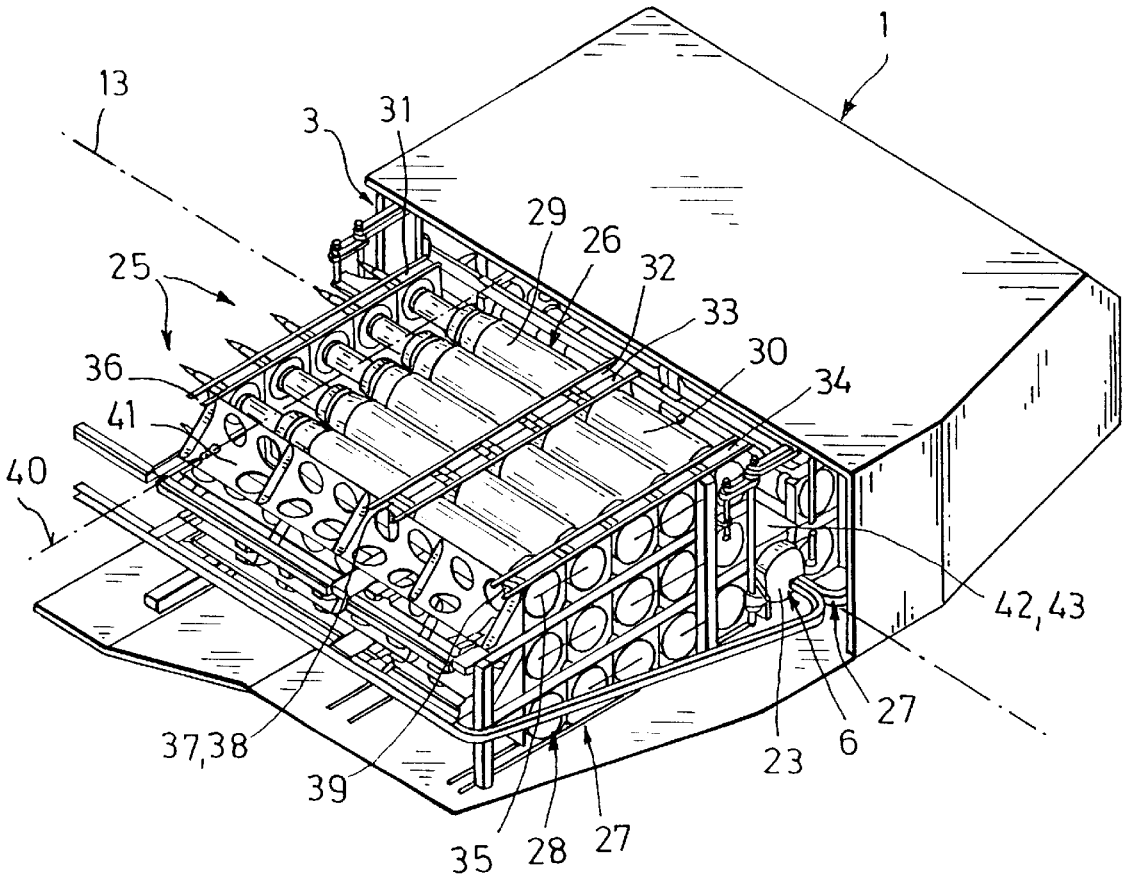
FIG. 3 is a perspective view of another preferred embodiment of the invention including an ammunition magazine for two-part ammunition.

FIG. 3 schematically shows a second embodiment of the invention in which the loading device 25 is designed for loading two-part ammunition 26. For better visibility of the ammunition magazine 27 only one partial magazine 28 is illustrated. The tank turret is designated at 1 and the device for charging the weapon with the charger 23 is designated at 6.

The ammunition 26 situated in the partial magazine 28 is composed of a frontal ammunition part 29 containing the projectile and a rearward ammunition part 30 containing the propellant. Each of the two ammunition parts 29, 30 is provided with two guide portions 31, 32 and 33, 34, respectively, so that each of the tiers 35 of the partial magazine 28 has four guide rails 36–39 oriented transversely to the longitudinal axis 13 of the weapon barrel. The guide portions 31–34 of the ammunition 26 project into the guide rails 36–39.

For shifting the ammunition 26 along the guide rails 36–39 threaded spindles 40 are provided which extend transversely to the longitudinal axis 13 of the weapon barrel. The spindles 40 drive carriers 41 which are pressed against the trailing ammunition 26 of the ammunition series and thus sequentially shift the ammunition into their removal position to that side which is oriented toward the elevator 42 provided with a loading tray 43.

It will be understood that the above description of the present invention is susceptible to various modifications, changes and adaptations, and the same are intended to be comprehended within the meaning and range of equivalents of the appended claims.

What is claimed is:

1. The combination of a weapon and ammunition to be loaded into the weapon; said weapon comprising (a) a weapon barrel having a longitudinal axis;

(b) a magazine positioned behind said weapon barrel and being formed of two spaced, facing partial magazines situated on either side of said longitudinal axis; each said partial magazine having at least one tier accommodating a series of ammunition in a side-by-side relationship;

(c) a loading tray positioned behind said weapon barrel and between said partial magazines for receiving ammunition therefrom to be loaded by said loading tray into said weapon barrel;

(d) displacing means for shifting the ammunition in each said tier onto said loading tray; and (e) at least two spaced guide rails positioned in each tier and extending perpendicularly to said longitudinal axis; each ammunition having (a) a frontal region;

(b) a rearward region; and (c) at least two guide portions releasably secured to the ammunition in said frontal and rearward regions, respectively; said guide portions engage into respective said guide rails.

2. The combination as defined in claim 1, further wherein each said partial magazine has at least two superposed tiers; further comprising an elevator disposed between said partial magazines for vertically moving said loading tray into a loading position after being charged with ammunition by said displacing means.

3. The combination as defined in claim 1, wherein said displacing means comprises endless chains and a drive for circulating said chains to shift said ammunition toward said loading tray.

4. The combination as defined in claim 1, wherein said displacing means comprises threaded spindles oriented perpendicularly to said longitudinal axis and a pusher threadedly connected to said spindles to press a trailing ammunition of said series in the respective tier in a direction of said loading tray.

5. The combination as defined in claim 1, further wherein each said guide rail has an end adjacent said loading tray; further comprising a stop positioned at said end of said guide rails; said stop having an operative position abutting a leading ammunition of said series to prevent said series from shifting toward said loading tray and a withdrawn position to allow said series to be shifted by said displacing means toward said loading tray.

6. The combination of a weapon and ammunition to be loaded into the weapon; said weapon comprising (a) a weapon barrel having a longitudinal axis;

(b) a magazine positioned behind said weapon barrel and being formed of two spaced, facing partial magazines situated on either side of said longitudinal axis; each said partial magazine having at least one tier accommodating a series of ammunition in a side-by-side relationship;

(c) a loading tray positioned behind said weapon barrel and between said partial magazines for receiving ammunition therefrom to be loaded by said loading tray into said weapon barrel;

(d) displacing means for shifting the ammunition in each said tier onto said loading tray; and (e) at least four spaced guide rails positioned in each tier and extending perpendicularly to said longitudinal axis;

each ammunition being a two-part ammunition formed of two separate ammunition parts; each said ammunition part having (a) a frontal region;

(b) a rearward region; and (c) at least two guide portions releasably secured to the ammunition in said frontal and rearward regions, respectively; said guide portions engage into respective said guide rails.

* * * * *